United States Patent [19]

Williams

[11] Patent Number: 4,476,823

[45] Date of Patent: Oct. 16, 1984

[54] HYDRAULIC VALVE TIMING CONTROL DEVICE FOR AN INTERNAL COMBUSTION ENGINE

[76] Inventor: John K. Williams, 4121 Cascade Rd., SW., Atlanta, Ga. 30331

[21] Appl. No.: 413,520

[22] Filed: Aug. 31, 1982

[51] Int. Cl.[3] ..... F01L 1/34

[52] U.S. Cl. ..... 123/90.12; 123/90.15

[58] Field of Search ..... 123/90.12, 90.13, 90.16, 123/90.15; 137/624.11, 624.13, 624.14, 624.15, 624.18, 624.2; 251/63.4; 74/55, 788, 801

[56] References Cited

U.S. PATENT DOCUMENTS

| | | | |
|---|---|---|---|
| 2,027,655 | 1/1936 | Stoeckicht | 74/801 |
| 2,290,626 | 7/1942 | Bosomworth | 137/624.13 |
| 3,209,737 | 10/1965 | Omotehara | 126/90.12 |
| 3,313,280 | 4/1967 | Arutunoff | 123/90.15 |
| 3,572,362 | 3/1971 | Pauliukonis | 137/624.14 |
| 3,683,874 | 8/1972 | Berlyn | 123/90.16 |
| 4,153,016 | 5/1979 | Hausknecht | 123/90.15 |

FOREIGN PATENT DOCUMENTS

| | | | |
|---|---|---|---|
| 599734 | 3/1948 | United Kingdom | 74/55 |

*Primary Examiner*—Michael Koczo
*Assistant Examiner*—Peggy A. Neils
*Attorney, Agent, or Firm*—James J. Brown

[57] ABSTRACT

A device is described for controlling the intake and exhaust valves of an internal combustion engine. Separate valve actuators are provided for opening and closing the intake and exhaust valves of each cylinder of an engine. Each such actuator is connected to a pair of cam actuated pumps for providing timed pulses of pressurized fluid to the valve actuators. The cams which actuate the pumps are turned by a planetary gear mechanism which permits the incidence of pump actuation in relation to the rotation of a shaft turned by the engine to be varied. The device permits close, precise and variable control of the valve timing of the engine to thereby achieve enhanced engine performance.

9 Claims, 7 Drawing Figures

HYDRAULIC VALVE TIMING CONTROL DEVICE FOR AN INTERNAL COMBUSTION ENGINE

SUMMARY OF THE INVENTION

The present invention is directed to a device for controlling and varying the valve timing of an internal combustion engine. More specifically, the invention is directed to hydraulic valve actuators for opening and closing the intake and exhaust valves of the engine and hydraulic actuator pumps for supplying precisely timed pulses of fluid to the actuators, the periodic action of the actuator pumps being varied by advancing or retarding a planetary gear assembly in relation to the revolution of a rotating shaft turned by the engine.

BACKGROUND OF THE INVENTION

Many of the present problems in society can be linked to the inefficient consumption of petroleum and the resulting rising cost and environment pollution. Reduction of our petroleum consumption rates increases the health of our society and economy. In addition, reduction of consumption rates assures that more of this valuable resource will be left for our prodigies to enjoy. Even the quality of our environment and the air we all breathe would be improved by more fuel efficient transportation vehicles.

The technologies proposed here are projected to provide an increase in efficiency of the internal combustion engine vehicles from the present arena of approximately 30% to a realm of 75 percent, thereby reducing petroleum consumption and helping to improve the environment.

The PRIOR ART

The inventor is aware of the following prior art which is considered most relevant to the present invention.

U.S. Pat. No. 3,313,280 to Arutunoff et al discloses a mechanism by which the valves of an internal combustion engine are opened and closed by a rocker arm which is pivotally mounted and responsive to a pair of laterally spaces cams.

U.S. Pat. No. 3,683,874 to Berlyn describes a valve actuating means in which a pump delivers oil under high pressure to a slave cylinder fitted with a piston.

U.S. Pat. No. 4,153,016 to Hausknecht describes a mechanism for regulating the opening of an engine valve during each cycle of operation by means of a hydraulically controlled system.

Additional less relevant patents which describe varous valve regulating mechanisms are:

U.S. Pat. No. 3,004,410 to Pierce, U.S. Pat. No. 3,277,874 to Wagner, U.S. Pat. No. 3,612,015 to Hausknecht, U.S. Pat. No. 3,626,720 to Meacham et al. U.S. Pat. No. 3,687,010 to Paxton, U.S. Pat. No. 3,817,228 to Bywater, U.S. Pat. No. 3,986,484 to Dyer, U.S. Pat. No. 4,203,397 to Soeters, Jr., and U.S. Pat. No. 4,244,553 to Escobosa.

DESCRIPTION OF THE INVENTION

Figure 1:
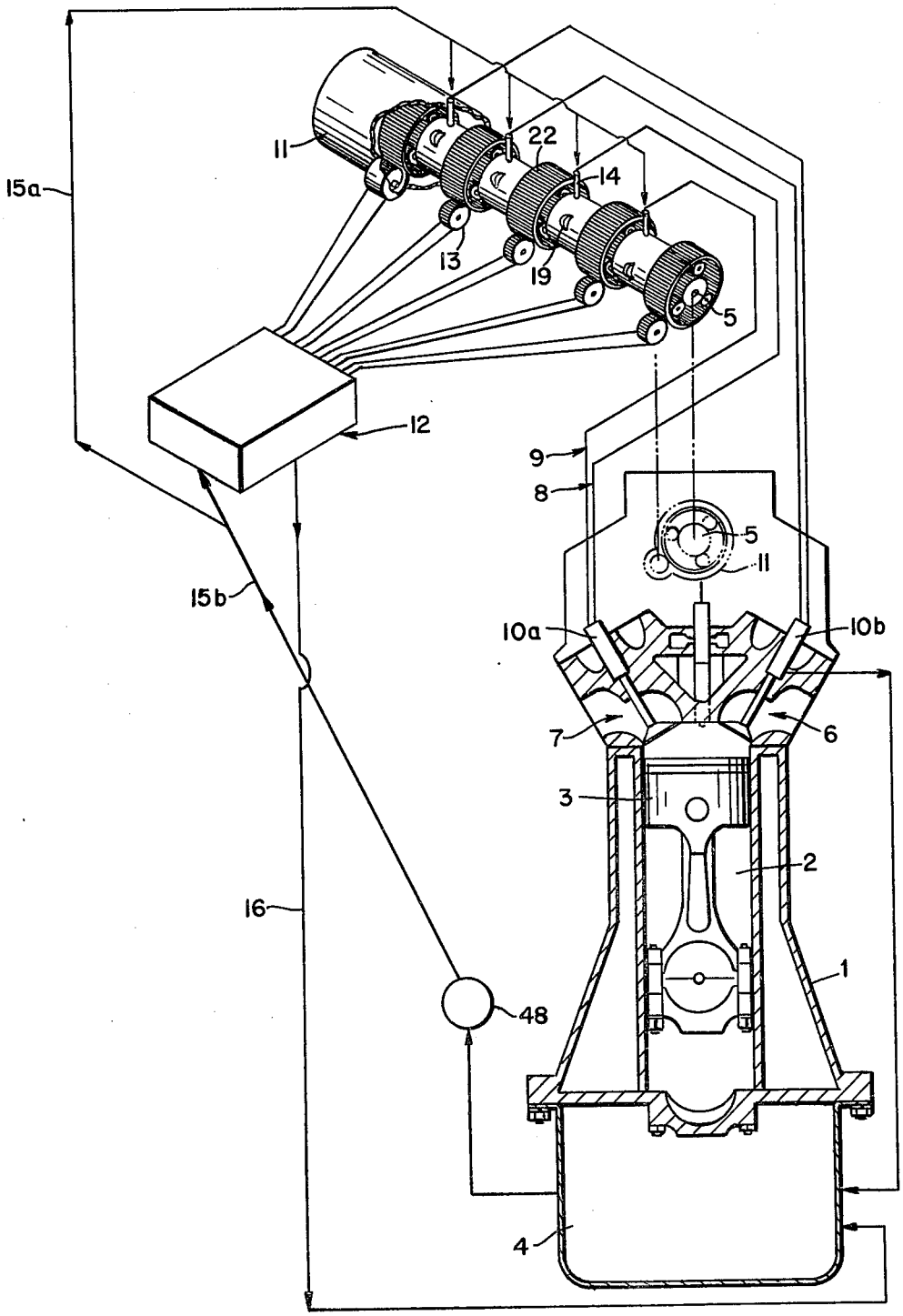
FIG. 1 is a schematic representative of a cut-away, single cylinder engine showing the actuator pump assembly and valve actuators of the invention.

In accordance with the present invention a device is provided for controlling the timing of the intake and exhaust valves of an internal combustion engine. Essentially, the present invention comprises separate valve actuator means for opening and closing each of the intake and exhaust valves of an internal combustion engine and a pair of actuator pump means connected to each valve actuator means for supplying precisely timed pulses of pressurized fluid to the valve actuator means to open and close each of the valves. Each actuator pump means comrises a piston disposed in a cylinder and mounted to periodically engage one or more cam lobes on a planet gear assembly which engages a rotating shaft turned by the engine. The piston of each pump is therefore depressed in a specifically controlled sequence which is related to the speed of the engine itself.

The cam lobes are mounted on a planet gear carrier disposed concentrically about a rotating shaft which is turned by the engine. Planet gears are mounted on the gear carrier and engage a sun gear which is mounted on and turned by the rotating shaft. The planet gears are also engaged by the inner portion of a ring gear which is disposed concentrically and outside of the sun gear. The ring gear is turned on command by a small servomotor which engages it on its outer periphery. Rotation of the ring gear thus causes the position of the cam lobe mounted on the planet gear to be advanced or retarded relative to the piston of the actuator pump thereby also altering the intervals at which the piston is depressed to provide sequential pulses of pressurized fluid relative to the rotation of the rotating shaft.

The valve actuator for opening and closing the intake and exhaust valves in response to the pulses of pressurized fluid which are received from the actuator pump essentially consists of a cylinder with first and second pistons slidably disposed end to end within the cylinder. The ends of the two pistons are connected by a compression spring. A valve stem terminating in a valve of the engine is connected to the end of the second piston and projects from the lower end of the cylinder. The upper end of the cylinder is connected to receive fluid pulses from one actuator pump in such a way that the pulse of pressurized fluid displaces the piston downward. The lower end of the cylinder is also connected to receive separate fluid pulses from an additional actuator pump so as to close the engine valve by displacing the second piston in the cylinder upward. The upper end of the cylinder is also provided with a fluid conduit means leading to a sump and the lower end of the cylinder is provided with a similar fluid conduit means leading to the same sump.

Each of the fluid conduits leading to the sump are provided with separate unique valve means for controlling the flow of fluid between the cylinder and the sump which thereby permits the return of the pistons to their former position. These unique valve means are integral to the cylinder and the two pistons mounted therein. Their operation during the sequence of events comprising a full cycle of the engine valve operation will be discussed in detail below with reference to the drawings. Essentially, two pairs of entry and exit ports are provided in the side of the cylinder. One pair of ports is disposed radially essentially along the mid-point of the upper piston's movement in the cylinder and connected into the fluid conduit leading from the bottom of the cylinder to the oil sump while the other pair of ports is disposed radially along the mid-point of the lower cylinder's path of movement, and connected into the fluid conduit leading from the top of the cylinder to the oil sump. Each of the pistons disposed within the cylinder is provided with a radially constricted portion which permits a flow of fluid around the cylinder when the constriction is in alignment with the pairs of ports provided radially in the side of the cylinder. Thus, as the two pistons within the cylinder move up and down in response to the pulses of pressurized fluid received at either end of the cylinder as well as the force of the compression spring between the two pistons, the respective pistons serve as valves to control the flow of fluid through the conduits leading to the sump, by either blocking or allowing the fluid to flow between the entry and exit ports.

As previously noted, the entire device of the present invention including the planetary gears, actuator pump mechanism and valve actuator permits variation of the valve timing in an internal combustion engine either as controlled by the operator or by control of a programmed solid state device such as a computer. The events of opening and closing of intake and exhaust valves can be varied infinitely to occur anywhere on the 720° rotation of the crank shaft or, in other words, at any point of travel between top dead center and bottom dead center of the piston on any stroke. Further, by means of the present invention, the valves may be operated in either two stroke or four stroke modes. By virtue of variable valve timing the engine can operate even as an air compressor or air motor.

In the preferred embodiment of the present invention the valve actuator pump receives its supply of fluid such as oil maintained under a constant pressure. The primary source of constant pressure may preferably be the engine's lubrication pump which supplies a constant pressure of oil. In turn, the actuator pump, in response to displacement of the pump plunger by a cam lube, displaces a precisely timed pulse of high pressure fluid.

Circumferential rotation of retarding or advancing of the actuator pump with respect to the cam will correspondingly retard or advance the timing of the high pressure signal. Conversely if the cam shaft is advanced or retarded in rotation while the pump remains stationary the timing of the high pressure pulse to the valve actuator is also retarded or advances. To facilitate 720° or infinite rotation of the cam shaft, a planetary gear system is utilized as described above. The engine crank shaft drives the sun gear preferably at a 1:1 ratio. The sun gear is properly geared and drives the planet gears so that the outer edge of the planet carrier rotates 2:1 in relation to the crank shaft. The outer edge of the planet carrier has at least one lobe which every 360° depresses the plunger of the actuator pump. When only this lobe is operating to depress the plunger of the actuator pump, the engine operates in a four stroke mode. A second cam lobe may, however, be provided on the outer edge of the planet carrier 180° from the first cam lobe. Preferably this second cam lobe can be moved either mechanically or hydraulically in and out of the path of the actuator cam plunger. When in the path of the plunger the engine will operate in a two stroke mode.

Two actuator pump assemblies are required for each valve. One assembly opens and the other closes the valve. In the event of multiple cylinder engines all intake actuator pumps are mounted circumferentially on one assembly with the same number of degrees between respective intake pumps as the number of crank shaft degrees differs between respective cylinders.

The hydraulic valve train system of the present invention can be infinitely varied in timing or valve events. This permits the operator to tailor the torque or output/rpm of an engine to meet any load or performance requirement from maximum torque at low rpm, as required for example by a truck or tractor engine, to maximum torque at high rpm as required by high performance race cars. Conversely, the fuel economies and pollution emission characteristics of the engine can be enhanced because the engines performance can be optimized at all times. All of these engine outputs can be changed while the engine is in operation. Further, because the torque/rpm can be tailored and variable valve timing, relatively flat torque/rpm curves can be obtained as compared with an engine with a static cam or limited variable valve timing device having a ball shaped torque/rpm curve. Therefore transmissions of closer ratios and fewer gears can be used.

DETAILED DESCRIPTION OF THE DRAWINGS

The details as well as operation of the present invention will, however, be better appreciated by having reference to the drawings.

Directing attention to FIG. 1, a schematic cross section of a single cylinder internal combustion engine is shown in which an engine block 1 is provided with a cylinder 2 having a piston 3 mounted therein. Oil sump 4 is provided with oil return line 16 and **15*b* leading from the sump to oil pump 48. Line 15*b* is further directed into fluid control module 12 while line 15*a* provides a source of constant low pressure fluid to the actuator pump assembly. Exhaust valve 7 is provided with a hydraulic valve actuator 10*a* while intake valve 6 is provided with a similar valve actuator 10*b*. Each of the actuator pumps 10*a* and 10*b* are provided with two fluid conduit lines each of which in turn leads to its own actuator pump activated by a separate planet carrier lobe. For purposes of describing the figure, reference will only be made to actuator valve 10*a* and the respective fluid conduits 8 and 9 for providing signals to open and close the valve, it being understood that actuator valve 10*b* possesses the same structure and function. Fluid conduit 8 leads to valve actuator 10*a* to provide the "open" valve signal received from actuator pump 14 which is mounted in the pump mechanism 11 to be periodically depressed by cam lobe 19. Similarly, conduit 9 leads to another actuator pump mechanism mounted also within mechanism 11 so that the valve actuator receives a "close" valve signal in proper sequence. Details of the construction and operation of the mechanism by which the cam lobe is turned by the shaft 5 to depress the piston or plunger in the actuator pump will be more fully described with reference to FIG. 2 of the drawings. The interval at which the cam engages the plunger on the actuator pump, is, however, controlled by a small motor (not shown) having a gear 13 which engages the large ring gear 22. This small control motor 13 is connected to the fluid control unit 12**.

Figure 2:
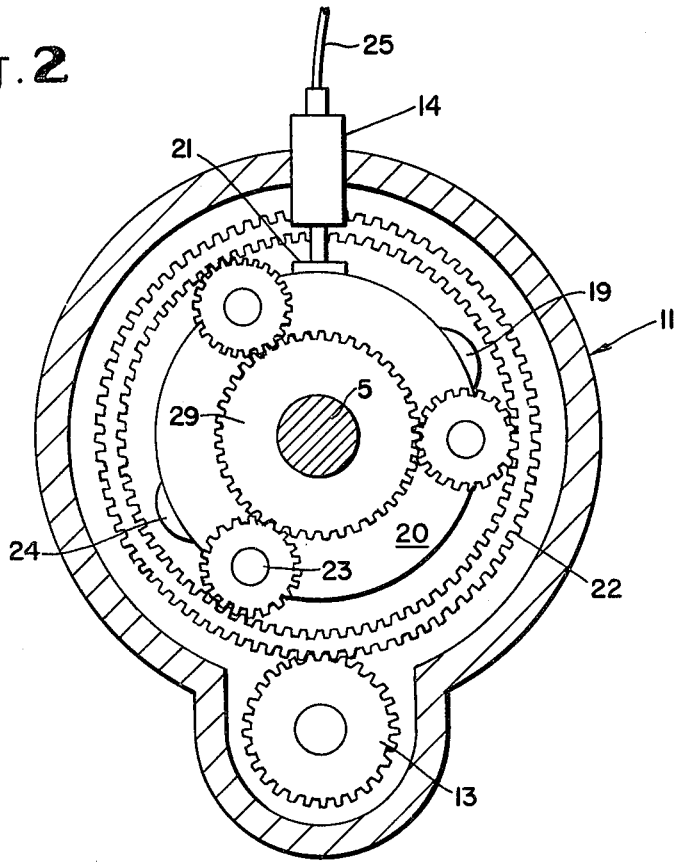
FIG. 2 is a cut-away view of the actuator pump and a planet gear assembly.

Directing attention to FIG. 2 of the drawings, the actuator pump within mechanism 11 is provided with actuator pump 14 having piston 21 slidably disposed therein. Within the mechanism 11 is rotating shaft 5, which is turned at a 1:1 ratio by the internal combustion engine itself. Disposed concentrically about the rotating shaft 5 is planet gear carrier 20 on which are mounted cam lobes 19 and 24. Planet gears 23 are also mounted on the planet gear carrier and engage a sun gear 29 mounted on and turned by the rotating shaft 5. The planet gears 23 also engage the inner portion of a ring gear 22 disposed outside of the sun gear 29. On its outer periphery the ring gear 22 engages a gear 13 which is driven by a motor controlled by the fluid control device 12. The relative interval therefore at which the cam lobes 19 and 24 engage the piston 21 to provide an impulse of high pressure fluid to the line 25 in relation to the turning of rotating shaft 5 is controlled by turning with gear 13 the ring gear 22 engaging the multiple sun gears 23.

Figure 3:
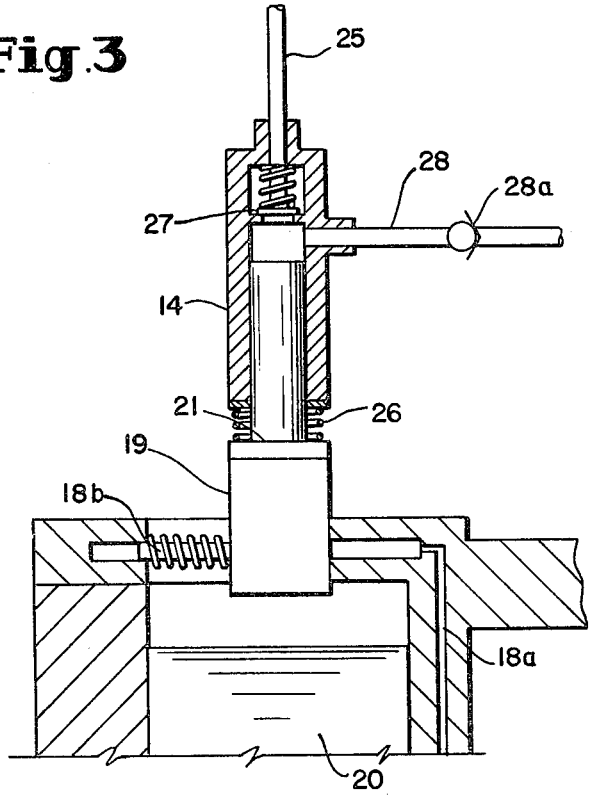
FIG. 3 is a cut-away of actuator pump.
Figure 4A:
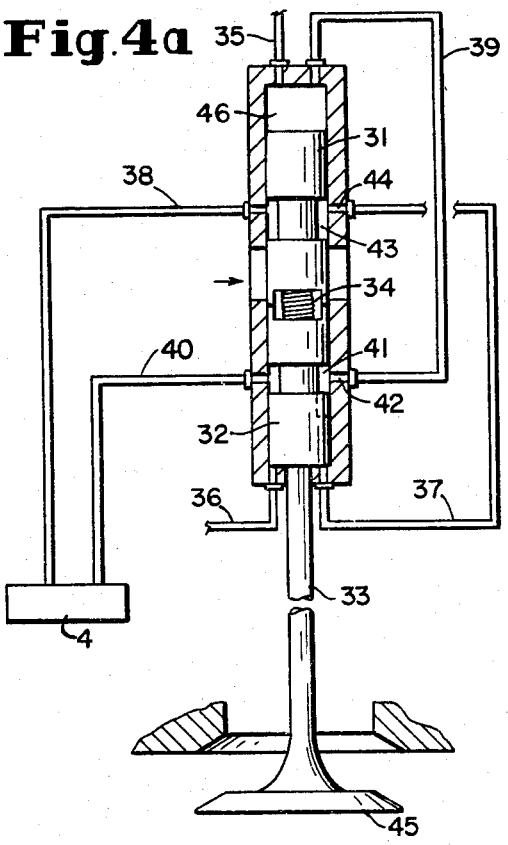
FIGS. 4*a–d* are cut-away views of the actuator valve illustrating the four-stage operation of the valve.
Figure 4B:
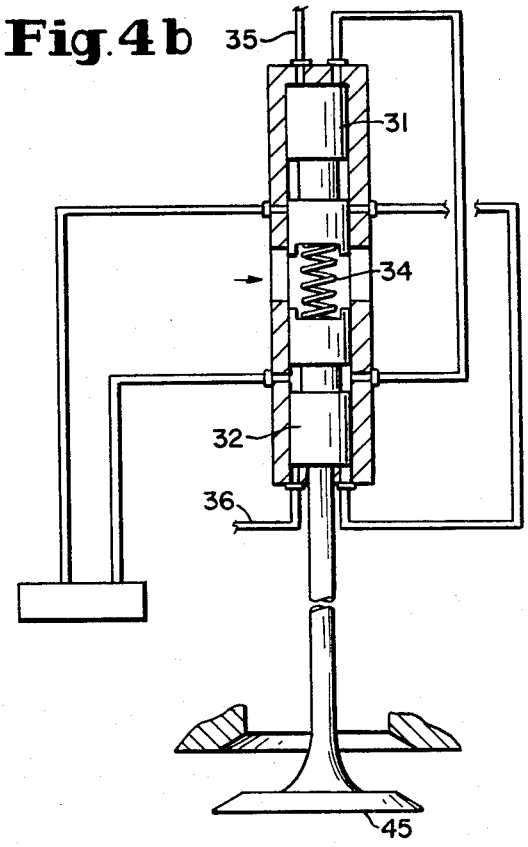
Figure 4C:
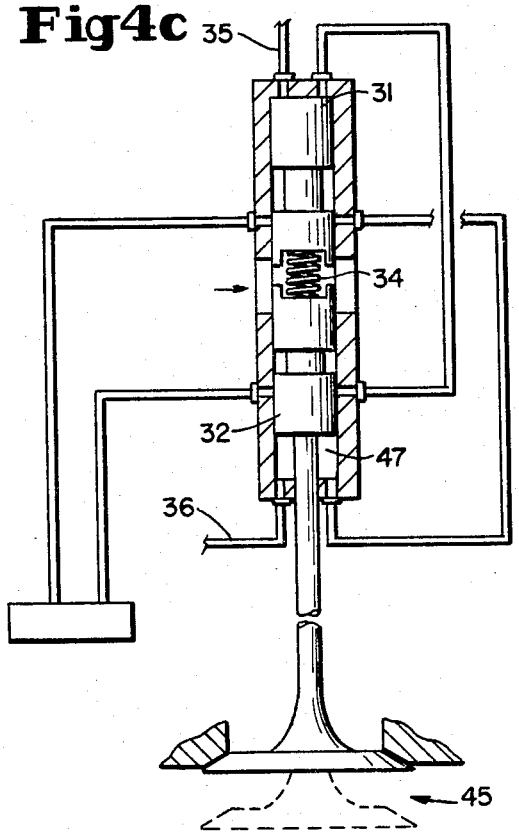
Figure 4D:
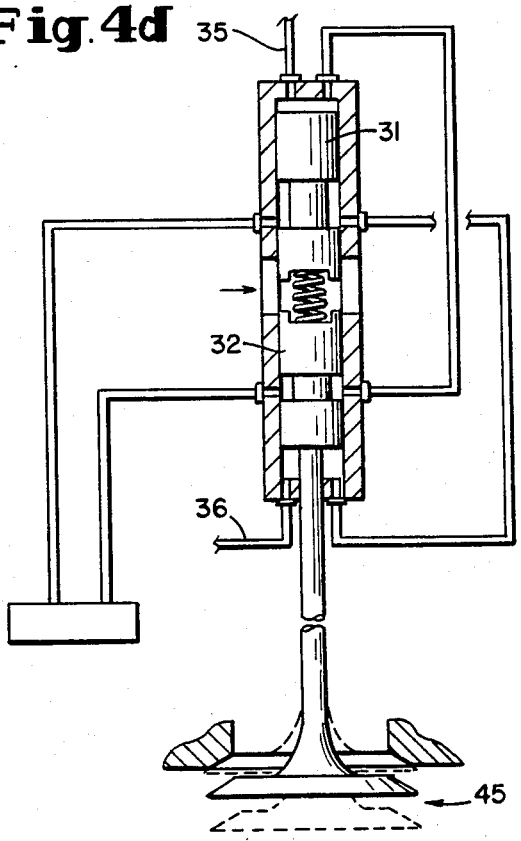

Directing attention now to FIG. 3, disposed within the actuator pump body 14 is piston 21 which projects downward to engage the cam lobes 19 mounted on gear carrier 20. Engagement of the lower end of the piston 21 with the cam lobe 19 is maintained by spring 26. Constant low pressure fluid, such as oil, is provided to the upper interior portion of the cylinder 14 through line 28 which is provided with a check valve 28*a* for preventing return flow of the pressurized fluid through that line. As the gear carrier 20 turns and brings the cam lobe 19 into engagement with the bottom of the piston 21, the piston is depressed upward in the cylinder 14 to cause a surge of high pressure fluid above the piston to be injected into the line 25. Valve 27 prevents return flow of the pressurized surge of fluid from the line 25 into the cylinder. In an optional embodiment of the present invention, a mechanism, which may be hydraulic as shown or mechanical is provided to move the cam lobe out of the path of the piston 21. As shown in the drawing, this provision can consist of a hydraulic line 18*a* provided with a suitable piston for moving the cam lobe 19 laterally with a return spring 18*b* for returning the cam lobe to position once the hydraulic pressure in line 18*a* is terminated. It will be apparent that other mechanical means for moving the cam lobe may be practiced within the scope of the present invention.

Directing attention now to FIGS. 4*a–d* of the drawings, the structure and operation of the valve actuator of the present invention will be considered. The valve actuator device of the invention consists of a cylinder 30 having disposed therein pistons 31 and 32 connected by compression spring 34. The lower piston 32 is connected by valve stem 33 to valve 45. A fluid conduit 35 is connected to one actuator pump which provides the time pulse of pressurized fluid from one actuator pump to open the valve 45. A second conduit 36 is connected to a second actuator pump for receiving a time pulse of pressurized fluid and to cause closing of the valve 45. Fluid conduit 39 directs pressurized fluid through valve means to conduit 40 and thence to sump 4. A similar fluid conduit 37 directs pressurized fluid from the bottom of the cylinder 30 through valve means to conduit 38 and then to sump 4.

The four stage operation of the valve actuator mechanism will now be considered: in stage one (FIG. 4*a*) a pulse of pressurized fluid is received from the actuator pump through line 35 into the top 46 of the cylinder 30 causing the piston 31 to be pressed downward thereby compressing spring 34 then contacting lower piston 32, and forcing the lower piston 32 downward to open the valve 45. In this mode the radial constricted portions 43 and 41 of the respective cylinders 31 and 32 are each respectively directly opposed to the pairs of entry and exit ports 44*a, b*, and 42*a, b* thereby permitting the flow of hydraulic fluid through the pairs of lines 39–40 and 37–38.

In stage 2 (FIG. 4*b*), the pulse of pressurized fluid through line 35 has ceased and the compression spring 34 forces the cylinder 31 back upward against the top of the cylinder 30. The radial constriction 43 in the piston 31 is now no longer opposed to the ports 44 so that the conduit 37–38 is closed to the flow of fluid. In this mode, although valve 45 is still open, it is now hydraulically free to move upward, if force is applied upward, for example, accidentally.

In the third stage (FIG. 4*c*) of operating a second hydraulic pulse of pressurized fluid is received through line 36 into the lower portion 47 of the cylinder 30 forcing the piston 32 upward and semi-compressing the compression spring 34. The radial indentation 41 around the piston 32 is no longer opposed to the port 42 so that line 39–40 is closed to a flow of fluid. In this mode therefore, both of the fluid conduits leading to the oil sump 4 are closed and the valve 45 is locked in a closed position. Unlocking of the valve 45 occurs in stage 4 (FIG. 4*d*) when a new pressurized surge of fluid is received through line 35 causing pistion 31 to move downward thereby opening the ports 44 to a flow of fluid through conduits 37–38. Release of fluid through the lines 37–38 relieves hydraulic pressure on the bottom of piston 32 thereby permitting it to move downward in response to pressure from spring 34 and movement of piston 31 and opening the valve 45. The valve actuator has now returned to the characteristics of stage one described above.

Further advantages and embodiments of the invention as described herein will, of course, be apparent and are considered to fall within the scope of the invention.

I claim:

1. A device for controlling the timing of the intake and exhaust valves of an internal combustion engine, said device comprising:

(1) separate valve actuator means for opening and closing each of said intake and exhaust valves;

(2) a pair of actuator pump means connected to each valve actuator means, for supplying controlled timed pulses of pressurized fluid under constant static pressure thereto to open and close respectively said valves;

(3) each of said actuator pump means comprising a piston slidingly disposed within a cylinder and mounted to periodically engage cam lobe means for depressing said piston to thereby provide said timed pulse of fluid;

(4) rotating shaft means turned by said engine; each of said caim lobe means being separately mounted on a planet gear carrier disposed concentrically about said rotating shaft means;

(5) planet gears mounted on said gear carrier and engaging a sun gear mounted on and turned by said rotating shaft means, said planet gears also engaging the inner portion of a ring gear disposed concentrically and outside of said sun gear; said ring gear engaging on its outer periphery means for controllably rotating the ring gear to thereby alter the position of said cam lobe means mounted thereon relative to said piston, thereby to alter the intervals relative to the rotation of said rotating shaft means at which said cam lobe means engages said piston and provides pulses of fluid to said valve actuator means.

2. The device of claim 1 wherein a second cam lobe means is mounted on the planet gear carrier opposite the first cam lobe means.

3. The device of claim 2 wherein said second cam lobe means is adapted to be moved out of the path of said piston.

4. The device of claim 1 wherein said fluid is supplied from a fluid source under constant static pressure to said actuator pump means.

5. The device of claim 1 wherein said crankshaft drives the sun gear at a ratio of 1:1 and said planet gears rotate at a ratio of 2:1 in relation to said crankshaft.

6. The device of claim 1 wherein each of said actuator pump means is provided with a check valve means for preventing the flow of pressurized fluid from said valve actuation means to aid pump means, and a second check valve means to prevent back flow of said fluid to the fluid source.

7. The device of claim 3 wherein said second cam lobe means is moved by hydraulic pressure.

8. The device of claim 1 wherein each of said valve actuator means for opening and closing said intake and exhaust valves comprising: a cylinder having therein first and second pistons disposed end to end and connected by compression spring means disposed between the respective pistons; said second piston being connected to a valve stem projecting from one end of said cylinder, the other end of said cylinder being connected to receive fluid pulses from said actuator pump means for opening the valve and having connected thereto first fluid conduit means leading to a sump; said other end of said cylinder being connected to receive fluid pulses from said actuator pump means for closing said valve and having also connected thereto second fluid conduit means leading to said sump; each of said first and second fluid conduit means being provided with separate valve means for controlling the flow of fluid between the cylinder and sump, the valve means for said first conduit and the valve means for said second conduit being respectively controlled by the sliding action of said first and second pistons within said cylinder.

9. A valve actuator for opening and closing the intake and exhaust valves of an internal combustion engine comprising: a cylinder with uniform bore diameter and having therein first and second pistons slidably disposed end to end and connected by spring means disposed between the respective pistons; said second piston being connected by compression spring means disposed between the respective pistons; said second piston being connected to a valve stem projecting from one end of said cylinder, the other end of said cylinder being connected to receive fluid pulses from an actuator pump means for opening the valve by forcing said first piston toward said one end and having connected thereto first fluid conduit means leading to a sump; said one end of said cylinder being connected to receive fluid pulses from said actuator pump means for closing said valve by forcing said second piston toward said other end and having also connected thereto second fluid conduit means leading to said sump; each of said first and second fluid conduit means being provided with separate valve means for controlling the flow of fluid between the cylinder and sump; said valve means for the respective conduits being provided by pairs of opposing entry and exit ports for said first conduit in the side of said cylinder where said first piston is disposed and in the side of said cylinder where said second piston is disposed for said second cylinder, each of said pistons being radially constricted to permit the flow of fluid from the entry to exit port when said constriction is opposed to said ports but otherwise for the respective pistons to block said flow of fluid when said constriction is not opposing said ports.

* * * * *